United States Patent [19]

Speraw et al.

[11] 3,960,420

[45] June 1, 1976

[54] CHECKOUT SYSTEM

[75] Inventors: Floyd G. Speraw, Cambridge; Thomas M. Hess, St. Clairsville; Harold J. Sampson, Cambridge, all of Ohio

[73] Assignee: NCR Corporation, Dayton, Ohio

[22] Filed: May 8, 1974

[21] Appl. No.: 468,120

[52] U.S. Cl. ..... 312/140.1; 186/1 A; 312/313; 312/314

[51] Int. Cl.[2] ..... A47B 46/00; A47B 96/18; A47F 9/02; A47F 10/00

[58] Field of Search ..... 186/1 A, 1 R, 1 AC; 312/313–317, 140

[56] References Cited

UNITED STATES PATENTS

| | | | |
|---|---|---|---|
| 2,122,969 | 7/1938 | Whitcomb | 312/314 X |
| 2,317,438 | 4/1943 | Bradley | 186/1 A |
| 2,560,490 | 7/1951 | Smith | 186/1 A X |
| 2,631,689 | 3/1953 | Rubaloff | 312/140.3 UX |
| 2,964,134 | 12/1960 | Bisen | 186/1 A |
| 3,077,950 | 2/1963 | Brown | 186/1 A |
| 3,557,907 | 1/1971 | Close | 186/1 AC |
| 3,558,204 | 1/1971 | Elliot | 312/313 X |

FOREIGN PATENTS OR APPLICATIONS

| | | | |
|---|---|---|---|
| 733,503 | 4/1957 | United Kingdom | 312/313 |

*Primary Examiner*—Paul R. Gilliam
*Assistant Examiner*—Carl F. Pietruszka
*Attorney, Agent, or Firm*—J. T. Cavender; Wilbert Hawk, Jr.; Richard W. Lavin

[57] ABSTRACT

An automatic checkout system for a supermarket, or other retail merchandise store or the like. The system includes a checkout counter and a bagging cart movably mounted to the rear of the checkout counter for supporting bags orientated to receive items from the checkout counter. In one mode of operation, the cart is positioned to allow the operator to both check out and load merchandise items into the bags on the cart. In another mode of operation, the cart is rotated away from the checkout counter and a counter shelf is positioned between the cart and the checkout counter to allow a bagger to continue to receive and load items from the checkout counter into the same bags. The construction of the checkout counter and the bagging cart allows transition from one mode of operation to the other to occur without interrupting the checkout operation.

6 Claims, 4 Drawing Figures

CHECKOUT SYSTEM

BACKGROUND OF THE INVENTION

The present invention relates to checkout counters and more particularly to a checkout counter which incorporates an optical reader for reading coded labels and automatically inserting the information into an electronic cash register or terminal device. This arrangement requires the operator during most of the checkout operation to merely move each merchandise item past the optical reading without attending the cash register, thereby measurably increasing the speed of the checkout operation. To further increase the checkout operation, prior checkout counter have been constructed to allow the operator to bag the merchandise items as they are being checked out. This arrangement is sufficient to handle all checkout conditions except during peak operating hours. During this latter time, a bagger is normally employed to help bag the items while the operator concerns herself with the checkout portion of the operation. Prior checkout counters were constructed to facilitate the bagging by either the operator or the bagger but not for both. When transferring the bagging operations from one to the other under these conditions, the checkout operation was disrupted which slowed the checkout operation. It is therefore a primary object of this invention to provide a checkout counter which will eliminate the above drawbacks. It is a further object of this invention to provide a checkout counter construction which can readily be adapted for different modes of bagging operations. It is a further object of this invention to provide a single checkout counter in which a high degree of bagging efficiency can be achieved in each of the modes of bagging operation described above. It is another object of this invention to provide a checkout counter of this type which is simple in construction and operation and therefore low in cost.

SUMMARY OF THE INVENTION

In order to carry out these objects, there is provided a checkout counter having an optical reader mounted adjacent the rear edge of the counter, a movable cart rotatably secured to the counter for movement between two positions, the cart having a bag support area positioned adjacent the rear edge of the counter when in a first position and positioned adjacent the location of a bagger when in a second position, the cart rotatably supporting a shelf member which is rotated to a position connecting the rear of the checkout counter with the bag support area of the cart when in the second position. The cart also supports a resiliently mounted flap member which holds a supply of bags adjacent the bag support area for easy bag replacement.

DESCRIPTION OF A PREFERRED EMBODIMENT

Figure 1:
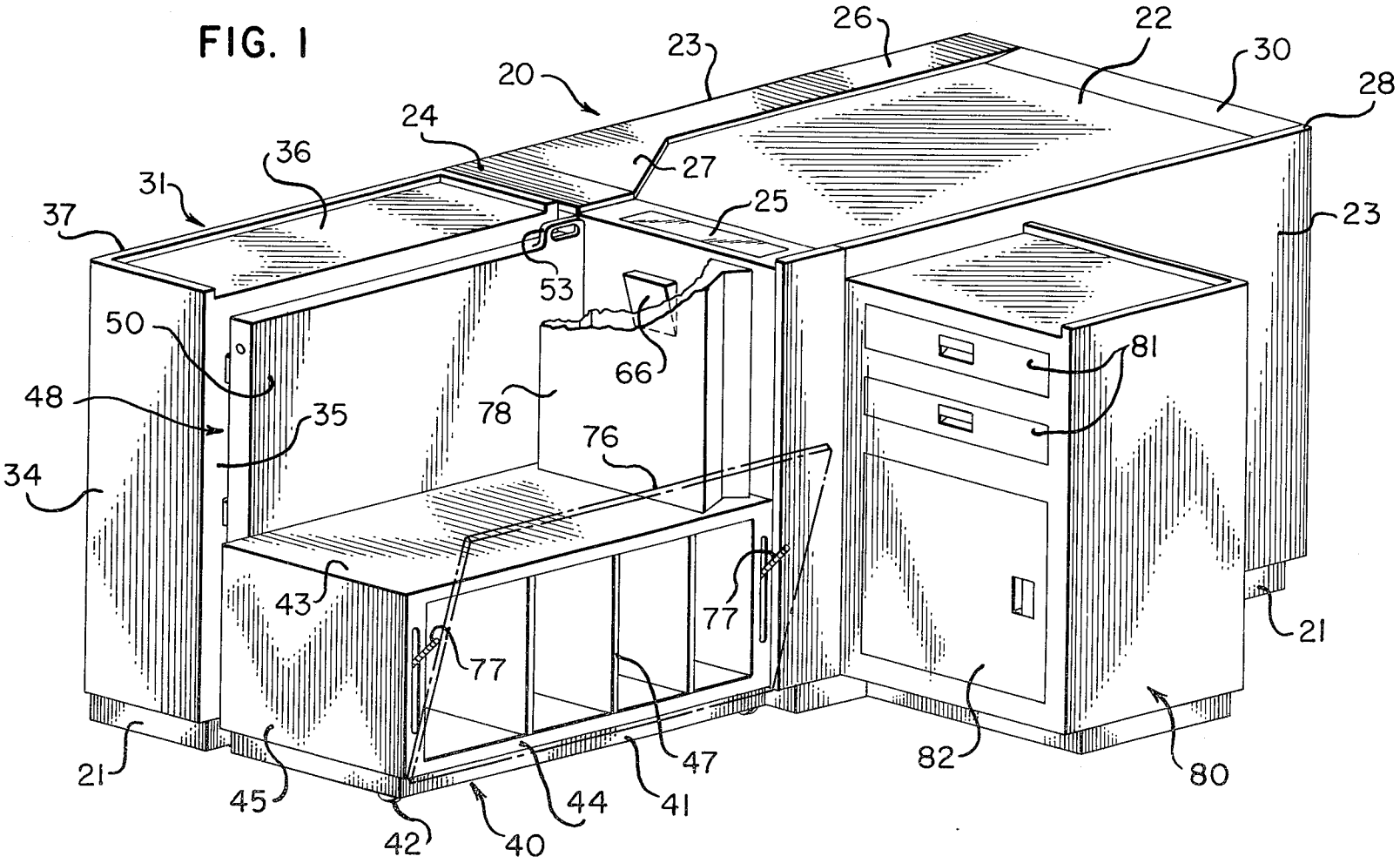
FIG. 1 is a perspective view of the checkout counter showing the bagging car in a position to allow the operator to check out and load the merchandise items.
Figure 2:
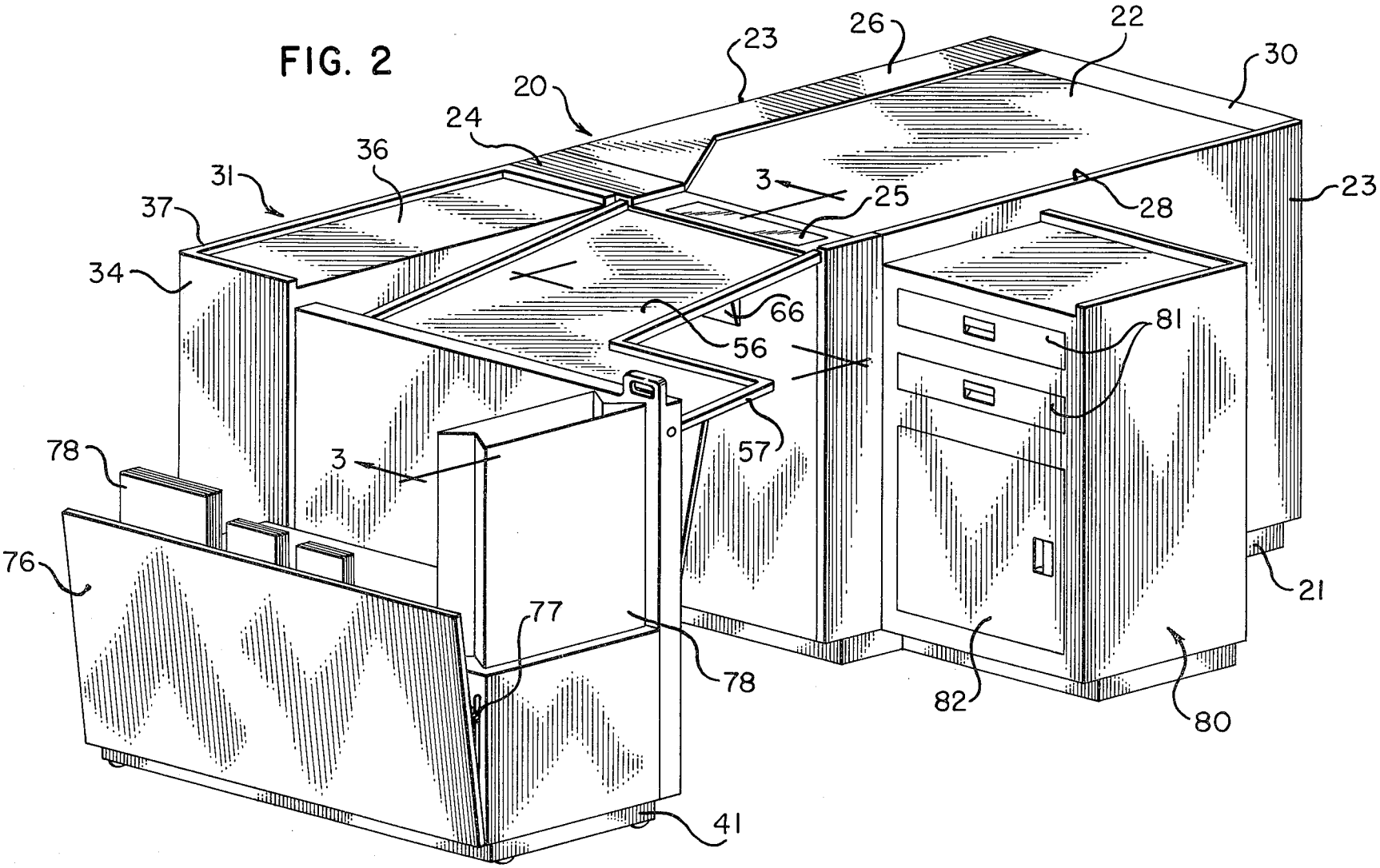
FIG. 2 is a perspective view of the checkout counter showing the bagging cart rotated 90° and the shelf member extended to connect the rear of the checkout counter with the cart.

Referring now to the drawing and particularly FIGS. 1 and 2, there is shown views of the checkout counter of the present invention which comprises an L-shaped structure 20 of conventional construction mounted on a base 21, the structure 20 having a front portion which includes a conveyor belt assembly 22 supported by a pair of side walls 23. Mounted adjacent the rear of the conveyor belt assembly 22 and to the side walls 23 is a housing 24 in which is positioned an optical reader mechanism (not shown) for reading through a window 25 coded labels on merchandise items which are moved past the window 25 by the checkout operator.

Mounted adjacent one side of the conveyor belt assembly 22 is a guide member 26 having an inwardly extending rear portion 27 which forms a throat passage with the top edge 28 of the opposite side wall 23 which extends upwardly from the conveyor belt assembly 22 for orientating the merchandise items adjacent the window 25. Mounted adjacent the front edge of the conveyor belt assembly 22 is an inclined guide member 30 for facilitating the movement of merchandise items onto the conveyor belt 22 which transports the items to a position adjacent the window 25.

Figure 4:
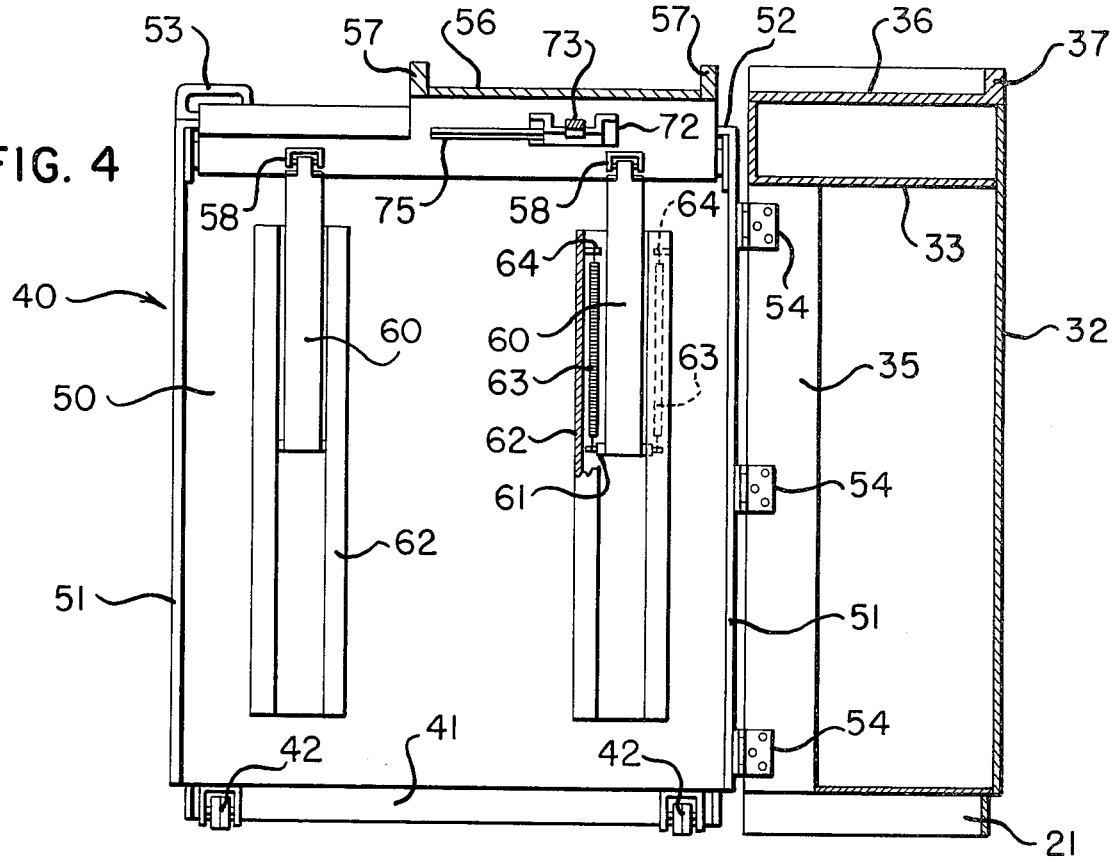
FIG. 4 is a sectional view taken on lines 4—4 of FIG. 3 showing details of the mountings of the cart and the shelf member.

Mounted on the rear portion of the base 21 is a housing 31 comprising a side wall 32 (FIG. 4) to which is secured a box-like structure 33, a rear wall 34 (FIG. 1) and a right-angled side wall 35 (FIGS. 1 and 4). The top of the rear wall 34 extends above the top surface 36 of the structure 33 forming a counter portion with a railing surface 37 of the structure 33. It will be seen from FIG. 1 that the width of the housing 31 is less than that of the front portion of the structure 20, thereby forming a recessed area in which is located a bagging cart 40. There may be located in the housing 31 coin dispensers, stamp dispensers, indicators, scales or other instrumentalities which can be utilized as part of a checkout operation.

The bagging cart 40 consists of a base 41 (FIGS. 1–4 inclusive) to which is mounted three castors or rollers 42 to allow for the movement of the cart 40. Mounted on the base 41 is a bag support structure which includes a top surface member 43, a bottom surface member 44, two side wall members 45 and a rear wall member 46 (FIG. 3) which, together with three partition members 47 (FIG. 1), form four compartments in which are stored bags 78 (FIG. 2) for use in bagging merchandise deposited on the conveyor belt 22.

Mounted to the rear wall member 46 of the bag support structure is a box-like structure 48 which includes a side wall member 50 (FIGS. 3 and 4) secured to the rear wall member 46, a pair of side members 51 and a top member 52. The side wall member 50 extends to a height less than the height of conveyor belt assembly 22. Mounted to the top member 52 is a slotted upstanding member 53 which functions as a handle. The structure 48 is pivoted to the housing 31 by means of hinges 54 mounted between one of the side walls 51 and the side wall 35 of the housing 31.

Mounted between the side walls 51 to the structure 48 is a shaft 55 (FIG. 3) to which is rotatably mounted an L-shaped shelf member 56 (FIGS. 2, 3 and 4) having surrounding rail portions 57. Rotatably secured to the underside of the shelf member 56 by means of hinges 58 are a pair of support arms 60. Each support arm 60 has a pin member 61 (FIG. 4) rotatably mounted at its other end and which is slidably disposed within a channel member 62 secured to the side wall member 50. A pair of springs 63 each mounted between a pin 64 secured to the channel member 62 and the pin member 61 functions as a counter balance to the weight of the shelf member 56 and assists in the movement of shelf members from a closed to an open position as shown in FIG. 3.

Figure 3:
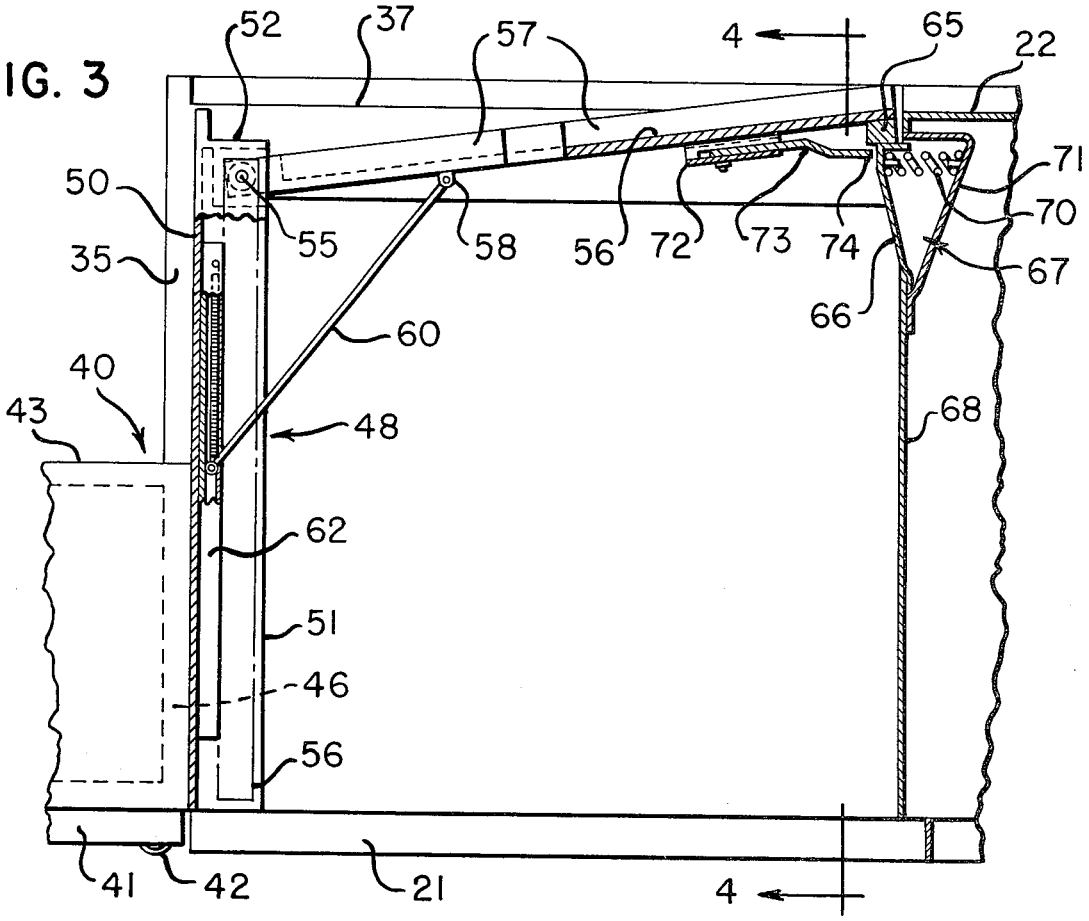
FIG. 3 is a sectional view taken on lines 3—3 of FIG. 2 showing details of the mounting of the shelf member in a closed and open position.

As best seen in FIG. 3, mounted to the front portion of the underside of the shelf member 56 is a support block member 65 which, upon rotation of the shelf member to an inclined position with respect to the conveyor belt assembly 22 will be positioned on a movable bent-over support flange member 66 rotatably mounted within a recessed area 67 of the rear wall member 68 of the housing 24. A spring 70 mounted between the flange member 66 and a rear panel 71 of the recessed area 67 normally urges the flange member 66 in a forward direction.

Mounted adjacent the block member 65 within a housing 72 is a slidably-mounted actuator member 73 having an end portion 74 positioned adjacent the flange member 66. A handle 75 (FIG. 4) rotatably mounted within the housing 72 and engaging the actuator member 73 is constructed to move the end portion 74 of the actuator into engagement with the flange member 66, thereby rotating the flange member in a clockwise direction against the action of the spring 70. This movement allows the operator to disengage the block member 65 from the flange member 66 and rotate the shelf member 57 back to its home position as shown in phantom lines in FIG. 3.

As shown in FIGS. 1 and 2, rotatably secured to the edge of the bottom surface member 44 of the bagging cart 40 is a door member 76 which is normally urged against the bag support structure of a pair of springs 77 mounted between the door 76 and the side walls 45 of the structure. As shown in FIG. 2, the spring urged movement of the door 76 will hold a supply of bags 78 in an upright position to facilitate their deployment in bagging merchandise items.

As shown in FIGS. 1 and 2 mounted adjacent the checkout counter is a support stand 80 on which may be mounted an electronic cash register or data terminal device for use in the checkout operation. The support stand 80 includes drawers 81 and a closet 82 for use by the operator of the data terminal. As part of a checkout operation, the operator will stand adjacent the support stand 80 and move the purchased items of merchandise past the window 25 in the appropriate manner to allow the optical reader located within the housing 24 to read the price of the item from a coded label located on the item. The price so read will be transferred automatically to the terminal device located on the stand 80 to be recorded therein and displayed in such a manner as to allow the customer to read it. After passing the item past the window 25, the operator will deposit the item in an open bag 78 located on the surface 43. As each bag is filled, the operator will remove another bag from the supply held by the door 76 and position the open bag in the surface 43 adjacent the previously filled bag.

If during this checkout operation, a bagger comes to assist the operator in bagging the merchandise items, the cart 40 will be swung around 90° from its position shown in FIG. 1 by means of the handle 53. The shelf member 56 will then be rotated in an upward direction until it is latched in an inclined position by the flange member 66 as shown in FIGS. 2 and 3. It will be seen from FIG. 2 that the checkout operation can continue without interruption. With the bagger standing adjacent the previously opened bag 78, the operator will continue to move the purchased items past the window and down the inclined shelf member 56 to a position where the bagger can continue to load the previously opened bag 78. It will be seen from this construction that in both positions of the cart 40, the bag loading area of the cart is adjacent the person who is required to load the bag.

When the checkout volume decreases to a point where the operator can effectively load the bags, rotation of the handle 75 will result in the actuator member 73 rotating the flange member 66 clockwise against the action of the spring 71 to disengage the support block 65, thereby allowing the shelf 56 to be rotated to its collapsed position and the bagging cart 40 rotated back to the position shown in FIG. 1. In this position, the previously opened bag 78 is located adjacent the housing 24 allowing the operator to continue the checkout operation by passing the purchased items past the window 25 and into the bag 78. Thus the same bag will be in position to continue the bagging operation when the cart 40 is rotated between its two operating positions.

It will be apparent that with the above-described structure of the invention, the checkout counter can be easily and swiftly converted to operate in two different modes of checkout operation without interrupting the checkout operation that is in progress.

Although the preferred embodiment of the device has been described, it will be understood that within the purview of this invention various changes may be made in form, details, proportion and arrangement of parts, the combination thereof and mode of operation, which generally stated consist in a device capable of carrying out the objects set forth, as disclosed and defined in the appended claims.

What is claimed is:

1. A checkout system including a. a checkout counter having an entrance portion at one end and a support portion at the other end, said counter having a recessed area located intermediate the ends of said counter, said recessed area defining a discharge end;

b. a cart comprising a box-like structure having a top surface extending in a horizontal direction for supporting a bag in an open position;

c. means for supporting said cart for movement;

d. a wall member secured to said structure and having a pair of side edge portions and a top edge portion located generally in the plane of said discharge end;

e. means for rotatably mounting a side edge portion of said wall member to said support portion for movement around a vertical axis to allow the cart to be moved to a nested position in said recessed area wherein the top surface of the box-like structure is positioned adjacent the discharge end of the checkout counter and to a second position perpendicular to said nested position wherein the top surface is aligned perpendicular to the first position of the top surface;

f. a shelf member;

g. means for rotatably mounting the shelf member to the top edge portion of the wall member for movement around a horizontal axis between a first position adjacent said wall member when the cart is in said nested position and an extended position engaging the discharge end of the checkout counter when the cart is in said second position to permit the movement of articles thereover from said discharge end to said cart;

h. and means for supporting the shelf member in said extended position.

2. The checkout system of claim 1 in which the top surface of the box-like structure is at a height elevation less than the elevation of the discharge end of the checkout counter whereby the open end of the bag supported on said top surface is positioned below the discharge end when the cart is in said nested position.

3. An article checkout system including a. a box-like structure having an entrance portion at one end, a support portion at the other end, a recessed area located intermediate the ends of the structure defining a discharge end and an elongated support surface for supporting articles thereon, said support surface extending between the entrance portion and the discharge end of the structure;

b. a cart comprising an elongated housing having a top surface for supporting a bag in an open position;

c. roller members secured to the bottom of the housing for movably supporting said housing;

d. a wall member having top and side edge portions secured to said housing and extending in a vertical direction above the top surface of the housing;

e. means for rotatably securing one of said edge portions of the wall member to the support end of the structure whereby the cart is adapted for rotation between a first position wherein the cart is positioned adjacent the discharge end of the support surface and a second position wherein the cart is positioned perpendicular to the box-like structure;

f. a shelf member pivotably mounted to the top edge of the wall member for movement around a horizontal axis between a folded position adjacent the wall member when the cart is in said first position and an extended position engaging the discharge end of the support surface when the cart is in said second position to permit the movement of articles thereover from the discharge end of the support surface to the cart;

g. and means for supporting the shelf member in said second position.

4. The checkout system of claim 3 in which the top surface of said housing is at an elevation less than the elevation of the support surface of said structure, the top surface supporting a bag in an open position adjacent the discharge end of the support surface when the cart is in said first position, the checkout system further including conveyor means mounted on said support surface for transporting articles from the entrance portion to the discharge end whereby the articles are positioned in the bag on the top surface of the housing.

5. The checkout system of claim 3 in which said housing includes front opening for storing replacement bags, and a door member hingedly secured to the front opening, the system further including means engaging said door member for normally urging the door into engagement with the front opening whereby upon positioning a plurality of replacement bags between the housing and the door member, said door member will hold the replacement bags in a position to be easily removed by the operator.

6. A checkout system including a. a generally closed box-like structure having surface means defining an elongated counter surface extending horizontally from a first end of said structure to a second end of said structure, said counter surface having a recessed portion defining the discharge end of the counter surface intermediate said first and second ends, said first end defining the entrance portion of the counter surface;

b. a cart comprisisng a housing member having a top surface portion defining a bag supporting surface;

c. a plurality of rotatable wheels mounted on said cart for movably supporting said cart on the floor;

d. a wall member having top and side portions secured to said housing, the top portion of said wall member extending in a horizontal direction and spaced above the bag supporting surface;

e. means for rotatably mounting the wall member to the structure adjacent the second end of the counter surface for movement about a vertical axis whereby the cart is rotatable between a first position wherein the bag supporting surface is adjacent the discharge end of the counter surface and a second position wherein the bag supporting surface is remote from the discharge end;

f. an elongated shelf member defining an article supporting surface pivotably secured to the top portion of the wall member for movement around a horizontal axis, the shelf member movable between a folded position adjacent the wall member when the cart is in said first position and an extended position engaging the discharge end of the counter surface when in said second position;

g. and means for supporting the shelf member in said second position whereby articles are moved over the article supporting surface from the discharge end of the counter to the bag supporting surface of the cart.

* * * * *